United States Patent [19]

Sayles

[11] 3,979,236

[45] Sept. 7, 1976

[54] ANTI-EROSIVE, SOLID ROCKET DOUBLE-BASE PROPELLANT COMPOSITIONS

[75] Inventor: David C. Sayles, Huntsville, Ala.

[73] Assignee: The United States of America as represented by the Secretary of the Army, Washington, D.C.

[22] Filed: Dec. 17, 1975

[21] Appl. No.: 641,409

Related U.S. Application Data

[62] Division of Ser. No. 579,655, May 21, 1975.

[52] U.S. Cl. ..... 149/19.8; 149/97; 149/100

[51] Int. Cl.[2] ..... C06B 45/10

[58] Field of Search ..... 149/19.8, 96, 97, 100

[56] References Cited

UNITED STATES PATENTS

| | | | |
|---|---|---|---|
| 3,706,609 | 12/1972 | Voigt et al. | 149/19.8 |
| 3,785,888 | 1/1974 | Shaver et al. | 149/100 X |
| 3,894,894 | 7/1975 | Elrick | 149/19.8 X |
| 3,905,846 | 9/1975 | Berta | 149/19.8 X |
| 3,923,564 | 12/1975 | Lantz | 149/97 X |

*Primary Examiner*—Edward A. Miller

*Attorney, Agent, or Firm*—Nathan Edelberg; Robert P. Gibson; Jack W. Voigt

[57] ABSTRACT

A means for reducing or eliminating the erosive burning which takes place during the burning phase of solid propelled rocket motors which have a large length-to-diameter ratio and/or slow-burning propellants is disclosed. The means comprises incorporating into the solid propellant, in limited percentages (0.1–1.0%), a silicate selected from talc, kaolinite, kaolin, muscovite mica, and feldspar. The silicate additive is effective for composite or double-base solid propellant compositions. The solid composite propellant compositions can vary widely in formulation ingredients to include numerous ballistic modifiers; however, the general formulation for a composite propellant contains in addition to the silicate, a high solids loading of an inorganic oxidizer such as ammonium perchlorate, a polybutadiene binder with curatives and crosslinking agents, and optional metal fuel, preferably aluminum. The polybutadiene can have carboxyl- or hydroxyl-terminal groups. The crosslinking agent for the carboxyl-terminated polybutadiene can be an epoxy compound. The hydroxyl-terminated polybutadiene can be crosslinked with a diisocyanate crosslinking agent. The double-base propellants include the cast double-base or the castable composite double-base compositions. The double-base propellants can also vary over a wide range in their formulations. In addition to including ballistic additives to meet the required performance criteria, these propellants contain nitrocellulose (12.6% N) or Fluid ball powder, energetic plasticizer such as triethylene glycol dinitrate (TEGDN), crosslinking and curing agents, and optional metal fuel.

2 Claims, No Drawings

ANTI-EROSIVE, SOLID ROCKET DOUBLE-BASE PROPELLANT COMPOSITIONS

DEDICATORY CLAUSE

The invention described herein may be manufactured, used, and licensed by or for the Government for governmental purposes without the payment to me of any royalties thereon.

This is a division, of application Ser. No. 579,655, filed May 21, 1975.

BACKGROUND OF THE INVENTION

Recent trends in solid-propelled rocket motor designs for tactical weapons have been towards higher operating motor pressure, greater motor length-to-diameter ratios, higher volumetric loadings of the propellant, and longer duration burning times due to employment of lower burning rate propellants. All of these trends result in worsened erosive burning conditions. Erosive burning, thus, strongly effects the efficiency with which the propellant is utilized.

Erosive burning is the term used to describe the condition in which the burning rate of a solid propellant is affected by the flow of high velocity gases parallel to the burning surface. In a typical grain design with flow channels of constant port area, erosion will generally occur inside the central perforation near the nozzle end where the gas velocity is high. Erosion is characterized by an increase in burning rate, and is usually expressed in terms of an erosion coefficient, $E = r/r_o$, where $r$ is the burning rate with erosion and $r_o$ is the burning rate of the same propellant without gas flow parallel to its surface.

Advantageous would be a means to control erosivity since it would be possible to decrease the channel cross-section and the channel volume and increase the relative amount of propellant in the motor. The erosion is most pronounced at the beginning of propellant burning and diminishes as the flow channel enlarges.

Therefore, an object of this invention is to provide an additive for a propellant composition for controlling the erosivity of the propellant when the propellant is burned in a rocket motor having a large length-to-diameter ratio.

Another object of this invention is to provide a selected additive for a slow-burning propellant composition for controlling the erosivity of the propellant when the propellant is burned in a rocket motor.

SUMMARY OF THE INVENTION

It has been discovered that when a limited percentage (0.1–1.0%) of a silicate selected from talc, kaolinite, kaolin, muscovite mica, and feldspar is incorporated into a solid propellant composition the erosivity of the burning propellant is controlled.

DESCRIPTION OF THE PREFERRED EMBODIMENTS

Various silicates, in particular, talc, kaolinite, kaolin, muscovite mica, and feldspar when incorporated into a solid propellant in limited percentages (0.1–1.0%) effects a reduction in propellant erosion. The selected additive does not adversely affect the smokeless characteristics of the propellant.

Erosive burning is the term used to describe the condition in which the burning rate of a solid propellant is affected by the flow of high velocity gases parallel to the burning surface of the propellant. The condition of erosive burning has been a prevalent problem in tactical, solid-propelled rocket motors and in solid-propelled sounding rocket motors where the designs have been towards higher operating motor pressure, greater motor length-to-diameter ratios, higher volumetric loadings of the propellant, and longer duration burning times due to the employment of lower burning rate propellants.

The propellant compositions which are employed in air defense missiles and sounding rockets which have the above trends in design are the ones where erosive burning most strongly affects the efficiency with which the propellant is utilized. These propellant compositions include double-base, and composite which are slow-burning propellants and which are employed in rocket motors that have a large length-to-diameter ratio.

The efficiency of additives intended to reduce erosion burning can be effectively assessed in a specially-designed test device. The test device consists of a 6-inch motor and a 2-inch motor connected in tandem. The 6-inch motor functions as a gas generator and the 2-inch motor functions as the test section. These motors can be fired at several pressure levels by using different nozzles with different throat diameters so that the Mach number at the end of the test grain can be approximately 0.4, 0.2, and 0.1. Pressure gages are positioned at the forward and aft end of each motor so that pressure changes can be readily detected. These changes in pressures can be related to changes in burning rates and changes in erosive burning.

I claim:

1. In a solid double-base propellant composition comprised of a binder of nitrocellulose, a plasticizer compound selected from the energetic plasticizer nitroglycerin and the less energetic plasticizer triethylene glycol dinitrate, and an optional metal fuel, the improvement to reduce erosive burning which is achieved by incorporating into said solid double-base propellant composition limited percentages from about 0.1 to about 1.0% of a silicate which reduces erosive burning which takes place during the burning phase of said solid double-base propellant composition when said solid double-base propellant composition is encased in a solid propellant rocket motor having a large length-to-diameter ratio, said silicate selected from talc, kaolinite, kaolin, muscovite mica, and feldspar.

2. The improvement to reduce erosive burning as set forth in claim 1 wherein said plasticizer is the energetic plasticizer nitroglycerin, and wherein said optional metal fuel is powdered aluminum.

* * * * *